US007378587B2

(12) United States Patent
Chang

(10) Patent No.: US 7,378,587 B2
(45) Date of Patent: May 27, 2008

(54) METHOD FOR FAST COMPRESSING AND DECOMPRESSING MUSIC DATA AND SYSTEM FOR EXECUTING THE SAME

(75) Inventor: Han Peng (Henry) Chang, New Territory (HK)

(73) Assignee: VTech Telecommunications Limited, Hong Kong (HK)

( * ) Notice: Subject to any disclaimer, the term of this patent is extended or adjusted under 35 U.S.C. 154(b) by 713 days.

(21) Appl. No.: 11/011,440

(22) Filed: Dec. 15, 2004

(65) Prior Publication Data

US 2006/0123981 A1 Jun. 15, 2006

(51) Int. Cl.
*G04B 13/00* (2006.01)
*G10H 7/00* (2006.01)

(52) U.S. Cl. ..... 84/609; 84/601; 84/616; 84/649; 84/654

(58) Field of Classification Search ..... None
See application file for complete search history.

(56) References Cited

U.S. PATENT DOCUMENTS 5,869,782 A * 2/1999 Shishido et al. ..... 84/609
6,525,256 B2 2/2003 Boudet et al.
7,081,578 B2 * 7/2006 Hikawa et al. ..... 84/603
2003/0182133 A1 9/2003 Kawashima et al.

FOREIGN PATENT DOCUMENTS

JP 9153819 10/1997

OTHER PUBLICATIONS

Jacob Ziv et al., "A Universal Algorithm for Sequential Data Compression", IEEE Transactions on Information Theory, vol. IT-23, No. 3, May 1977.

* cited by examiner

*Primary Examiner*—Marlon T Fletcher
(74) *Attorney, Agent, or Firm*—Paul, Hastings, Janofsky & Walker LLP

(57) ABSTRACT

MIDI compression and decompression methods that reduce the size of a standard MIDI file and maintains information to play the MIDI music. The exemplary method of the invention makes use of the high correlation and repetitions between a look-ahead MIDI event and previous set of MIDI events. An adjustable size Lempel-Ziv-like MIDI Event Search Window (MESW) is created during the compression and decompression process to allow searching of matched events or event elements in previous window size of MIDI events. Further reduction of the MIDI events can be made by discarding the matched events in the event search window. Therefore, with 4-bit of MIDI event search window, the number of MIDI events stored in the window can be more than 16.

52 Claims, 5 Drawing Sheets

METHOD FOR FAST COMPRESSING AND DECOMPRESSING MUSIC DATA AND SYSTEM FOR EXECUTING THE SAME

BACKGROUND

Field of the Invention

The present invention relates generally to a method for processing music data and more particularly, to compression and decompression methods associated with reduction of the size of a music file. Exemplary embodiments of the invention relate to processing of standard Music Instrument Digital Interface (MIDI) files.

BACKGROUND OF THE INVENTION

More advanced cordless telephones are now equipped with the capabilities for storing MIDI melody data in a ROM. The MIDI melody data can be played by the cordless telephone as polyphonic ring-tones. Since the ROM has a limited memory size and is costly, it is highly desirable to compress the melody data so that more MIDI songs can be stored in the limited memory of the ROM. Furthermore, due to a limited computational processing power of the cordless telephone, the decompression method used therein should be as simple as possible.

Conventionally, to read MIDI data, the cordless telephone first extracts basic MIDI playing information from standard MIDI file (SMF). The basic MIDI playing information is then compressed by a compression method according to music note properties to convert the music data into another form of performance event information. The performance event information includes status information corresponding to a matching or mismatching pattern in note information between the piece of performance event information and an immediately preceding one of the pieces of performance event information.

However, the conventional method suffers from several disadvantages. First, the note length of duration and gate time consist of only 8 level of time resolution.

They are namely Whole Note, Half Note, Quarter Note, Eighth Note, Eighth Triplet, Sixteenth Note, Sixteenth Triplet and Thirty-Second Note. The 8 level timing resolution makes this compression impractical to convert general MIDI file into a compressed format. Also, defining note length in this way has the limitation that the MIDI file has to be converted to channel trunk-by-channel trunk basis before compression.

Second, the channel trunk-by-channel trunk based compression is not suitable for small size MIDI data that is commonly used in embedded system applications, which includes, for example, cordless phone polyphonic ringtone generation, mobile phone polyphonic ringtone generation, and PDA applications. The performance event overhead would be relatively large and the decompression is inefficient for an embedded system (e.g., cordless telephone) in which computational processing power resource is limited.

Third, the method only considers matching of the present event and the immediate preceding event, which is not efficient. In many cases, the maximal matched repetition pattern of MIDI event is in the previous several events instead of immediately preceding one. Therefore, further improvement can be made by considering more preceding events.

Fourth, the decompression of the note length into absolute time that uses tempo and channel-by-channel based decoding is relatively computational intensive. A simpler decoding strategy is more desirable.

Finally, event-by-event real time decompression is not trivial because the compressed MIDI events are not stored in the order of incremental time sequence.

Accordingly, an improved compression and/or decompression method for MIDI data is desirable.

BRIEF SUMMARY OF THE INVENTION

The exemplary method of the invention makes use of the high correlation and repetitions between a look-ahead MIDI event and previous set of MIDI events. An adjustable size Lempel-Ziv-like MIDI Event Search Window (MESW) is created during compression to allow searching of matched events or event elements in previous window size of MIDI events. Further reduction of MIDI events could be made by discarding the matched events in the event search window. Therefore, with 4-bit of MIDI event search window, the number of MIDI events stored in the window could be more than 16.

In accordance with a first embodiment of the present invention, a method for compressing music data comprises extracting music data events from a music file, generating a music data event search window, searching for one previous event in the music data event search window that has optimal matching with an event of a look-ahead window; and storing an index of the optimal matching event in a compressed codeword. In the embodiment, the music data event search window comprises a plurality of previous events and is used for searching for at least one previous event that matches with the event in the look-ahead window; and each event comprises a number of event elements.

Further, according to the first embodiment, each of the music event comprises five event elements: a Delta time, a Duration, a Note, a Velocity, and an Instrument. The method compares if any one of the event elements in the event of the look-ahead window is the same as a corresponding one in the optimal matching event of the MESW, and setting corresponding bits of part A of the compressed codeword. If any one of the event elements is not the same as the corresponding one in the event with optimal matching in the MESW, the different element is packed into part B of the codeword.

A second embodiment of the present invention further provides a method for decompressing a compressed music data file. The method comprises extracting music data events from the compressed music data file and generating a music event search window, wherein the music event search window comprises a plurality of previous events and is used for searching for at least one previous event that matches with an event of a look-ahead window; and wherein each event comprises a number of event elements. The method further obtains an index of a previous event in the music event search window that has optimal matching with the event of the look-ahead window, wherein the optical matching event comprises a codeword, and checking the codeword of the optimal matching event. According to the embodiment, if a respective bit of the codeword of the optimal matching event is set to "HIGH", an event element corresponding to the respective bit is read from the codeword. If a respective bit of the codeword of the optimal matching event is not set to "HIGH", an element corresponding to the respective bit is packed into the codeword.

A third embodiment of the present invention provides a system for compressing music data. The system includes a reader for reading a music file, an extractor for extracting music events from the music file, a compressor for compressing the music events into a compressed music file, and a search window generator for generating a music event search window. The music event search window is generated during a compression process performed by the compressor. The music event search window comprises a plurality of previous events and is used by the compressor for searching events matched with a look-ahead window event. Each event comprises a number of event elements. When a previous event in the music event search window that has optimal matching with the event of the look-ahead window is found, an index of the optimal matching event is stored in a compressed codeword.

A fourth embodiment of the present invention provides a system for decompressing music data that includes a reader for reading the music data from a memory, wherein the music data is compressed data, a decompressor for extracting music events from the compressed music data and decompressing the music events, a search window generator for generating a music event search window during a decompression process performed by the decompressor, and a music reproduction module for receiving decompressed music data from the decompressor and playing music songs corresponding to the decompressed music data. According to the system, the music event search window comprises a plurality of previous events and is used for searching events matched with a look-ahead window event and each event comprises a number of event elements. The decompressor obtains an index of a music event search window event from the extracted music events that has optimal matching with the look-ahead window event, and comprises a codeword, and the decompressor decompresses the compressed music data according to the index.

DETAILED DESCRIPTION OF THE INVENTION

According to a preferred embodiment of the present invention, an exemplary compression-decompression method makes use of the standard MIDI event property that significantly reduces the memory storage in an embedded system, e.g., a cordless telephone, by lowering the system BOM (bill of materials) cost. Furthermore, the decompression method of the invention is highly suitable for an encoder-decoder system implemented in limited processing power resources system.

Figure 1:
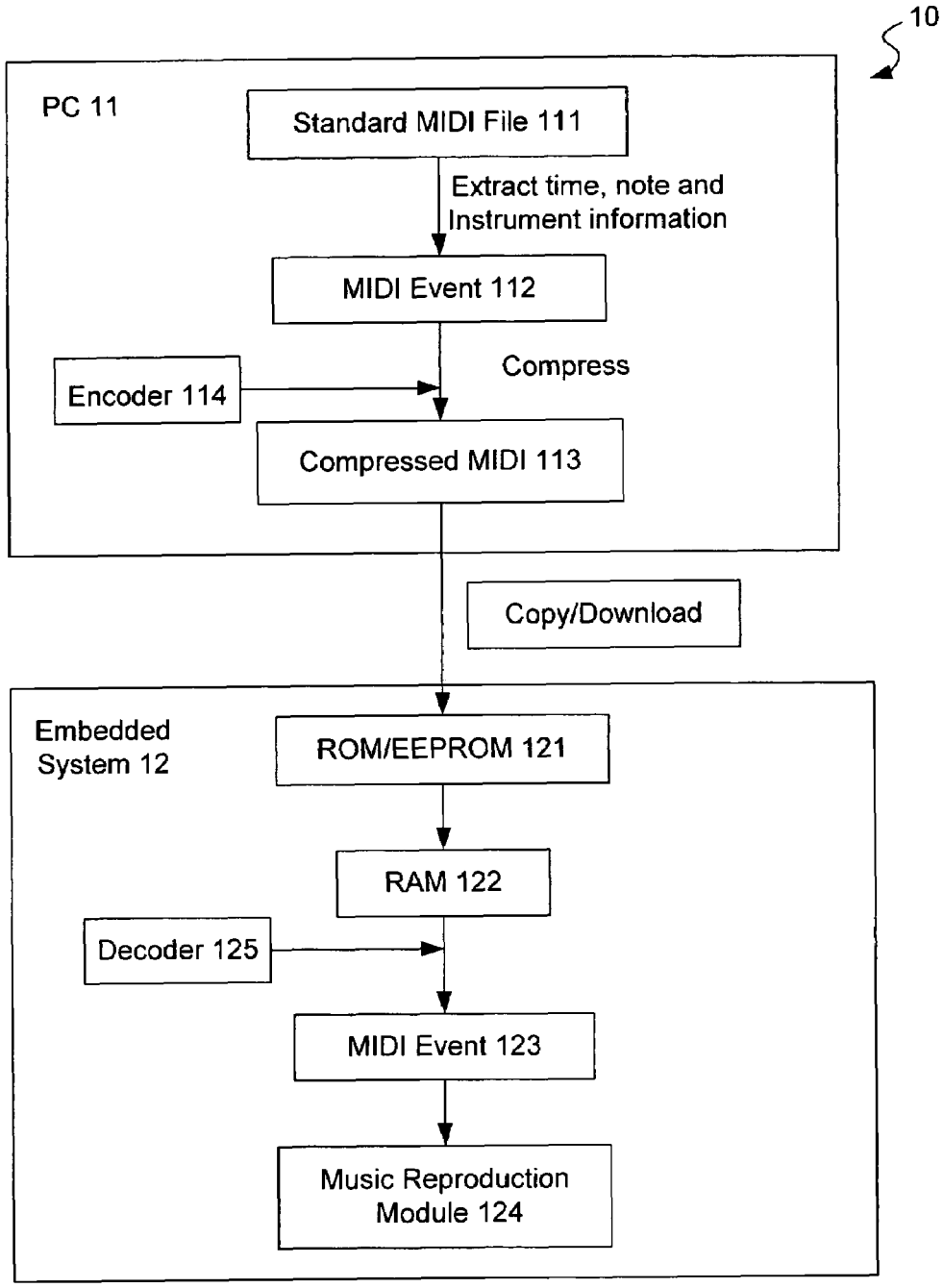
FIG. 1 is a schematic diagram showing an exemplary system of the invention.

FIG. 1 is a schematic diagram showing an exemplary system of the invention. System 10 uses PC system 11 to read music data, e.g., standard MIDI file (SMF) 111, and to download the music data to embedded system 12, such as a cordless telephone or cellular telephone. It is noted that other devices could be configured to benefit from the invention. During the reading of SMF 111, the information that is required for a MIDI music playing engine, including time, note, instrument, and volume, is first extracted to form a number of MIDI events 112. Further, tempo information of the SMF is combined with the MIDI timing to produce time scale in second. In accordance with the present invention, each extracted MIDI event includes five elements, including Delta Time, Duration, Note, Velocity and Instrument. The format of each of the MIDI event element is described in Table 1 below.

TABLE 1

| MIDI Event Element | Description |
|---|---|
| Delta Time | Time between start of current event and start of previous event, 1-bit represent time in second, 7-bit represent time within 1 second. |
| Duration | Duration of MIDI event with same format as Delta Time. |
| Note | MIDI note - 48, 6-bit represent 6 octave with frequency range from 131 Hz to 3.95 kHz. |
| Velocity | Volume of each event. |
| Instrument | Total 16 instrument used by selecting 1 instrument from each MIDI instrument group. |

Figure 2:
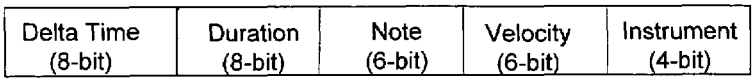
FIG. 2 shows a packing sequence of different elements in each MIDI event.

The MIDI event elements of each MIDI event can be packed as shown in FIG. 2. For example, as indicated in FIG. 2, a 4-byte (i.e., 32 bits) storage is needed for each event. Still, it is highly desirable if the storage per event can be further reduced so that more MIDI songs can be stored in the ROM associated with the embedded system. According to a preferred embodiment of the invention, the number of bits used for each element can be further reduced.

Referring FIG. 1, after PC 11 extracts MIDI events 112, the extracted MIDI events 112 are then compressed into compressed MIDI 113 by encoder 114 or a PC software program. The compression method is described below with reference to FIG. 3. Next, compression MIDI 113 is either downloaded or copied to ROM/EEPROM 121 of embedded system 12 that requests compressed MIDI 113. As stated above, exemplary embedded system of the invention includes cordless telephones, cellular telephone, and other devices that can be configured to play musical files. When playback of the music is required, compressed MIDI 113 is then read to RAM 122 of embedded system 12 for decompression by decoder 125. The decompression process recovers MIDI events 123 that are then passed to a music reproduction module 124 in the embedded system application, which reproduces the MIDI songs.

Preferably, during the compression and decompression process, an adjustable size MIDI Event Search Window (MESW) is constructed. The MESW is then used to find an optimal match between a look-ahead window event element and a MESW event element. Preferably, the optimal window-size can be selected based on the MIDI properties, making use Lempel-Ziv-like real-time data compression algorithm that is similar to Lempel-Ziv data compression algorithm (LZ77).

Furthermore, a single byte LZ77-like header can be constructed for each compressed MIDI event to store two pieces of information. The first piece information is the indication of matching of individual elements between the look-ahead window event and the MESW event. The second piece information is the index number in the MESW that has the maximal match with the MIDI event look-ahead window. The header is described in more details below.

Figure 3:
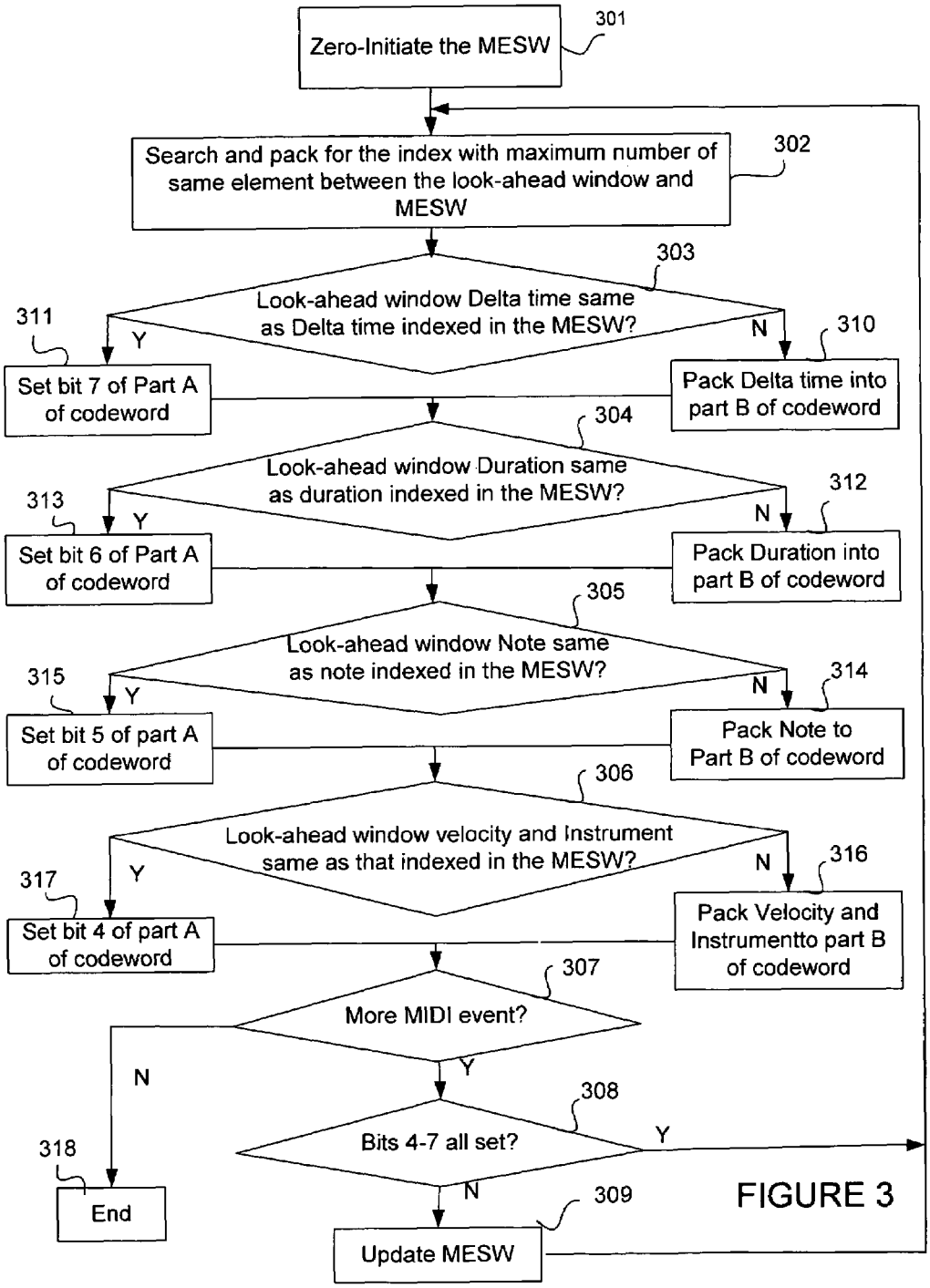
FIG. 3 is a flow chart showing an exemplary compression process of a preferred embodiment of the present invention.

An exemplary process for compressing/encoding the MIDI event extracted by PC 11 is illustrated in FIG. 3. As mentioned above, the extracted MIDI event is in the form shown in FIG. 2. Further, a size-adjustable MESW can be constructed during the encoding process for searching for an optimal match. Unlike LZ77 that uses characters to construct a search window and a look-ahead window, the preferred embodiment of the invention makes use of the MIDI event element to construct the event-based search window and the event-based look-ahead window.

At step 301, initially, all the MESW elements are set to zero.

At step 302, the Lempel-Ziv-like MESW is constructed for searching to find an index of MESW with the optimal match between the look-ahead window event element and the MESW element.

Figure 4:
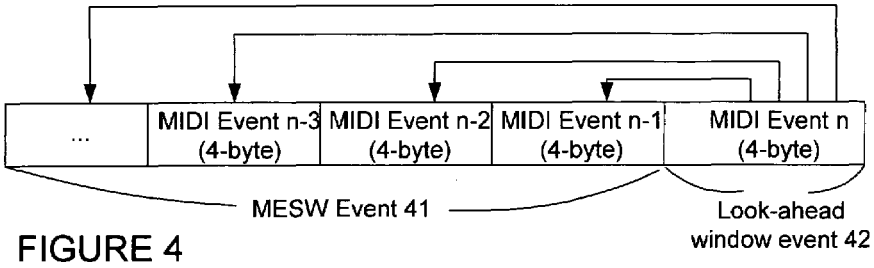
FIG. 4 is a diagram showing a searching manner of a MIDI event search window (MESW) used in a preferred embodiment of the present invention.

The operation of searching for optimal match between MESW and look-ahead window is further shown in FIG. 4. Refer to FIG. 4, each previous event is searched backward until the maximum search window size is reached. If there is a previous event in MESW 41 exactly the same as look-ahead window event 42, then the index of this previous MESW event is stored in a codeword. If there is no perfect match of current event and previous event in MESW events 41, the previous event index with optimal matching is then stored in the codeword. The index with optimal match is defined by the index with maximum of summation of same MESW element multiplied by MESW element per bit between the MESW and the look-ahead window. Those elements having different bits between the optimal MESW event and look-ahead window event are also stored in a compressed codeword.

Figure 5:
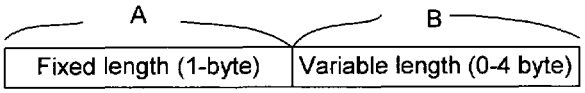
FIG. 5 illustrates a format of a compressed codeword of a preferred embodiment of the invention.

An exemplary format of each compressed codeword in accordance with the invention is as shown in FIG. 5. The exemplary format includes two parts, namely Part A and Part B. Part A has a fixed length with a size of 1 byte and is used to store the matching information between the MESW and the look-ahead window. Part B is variable in length with a size ranging from 0 bit to 32 bits. As a result, the minimum length of a codeword for an event is 8 bit, while the maximum length of codeword for an event is 40 bits.

Figure 6:
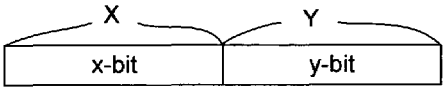
FIG. 6 illustrates a format of Part A of the compressed codeword of FIG. 5.

As shown in FIG. 6, Part A of the codeword further includes two sub-parts, namely X and Y. Sub-part X has a fixed length with a size of x-bit and is used to store status information to indicate the matching of each searching element between the optimal matched MESW and the look-ahead window. A particular bit in the x-bit in sub-part X indicates the matching of a particular searching element, such as one of the elements of the Delta Time, Duration, Note, Velocity, and Instrument, between the optimal matched MESW and the look-ahead window. An example with x-bit equal to 4 is shown in FIG. 7.

Figure 7:
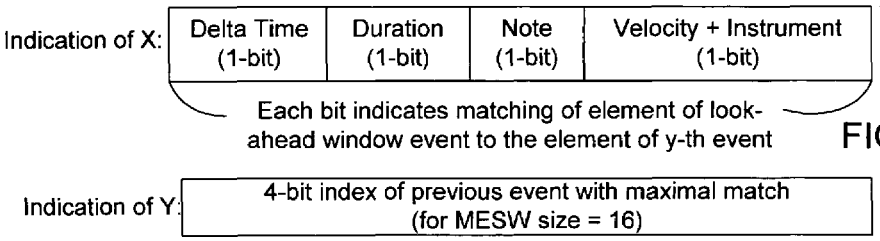
FIG. 7 illustrates formats of sub-parts X and Y of Part A of the compressed code words of FIG. 6.

Also in FIG. 7, sub-part Y has a fixed length with a size of y-bit. Sub-part Y is used to store the index of the optimal match between the MESW and the look-ahead window. The y-bit in sub-part Y also determine the MIDI event search window size. FIG. 7 shows an example with MESW size equal to 16. As the total size of X and Y is 1 byte (8 bits), x-bit plus y-bit should equal to 8 bits.

Figure 8:
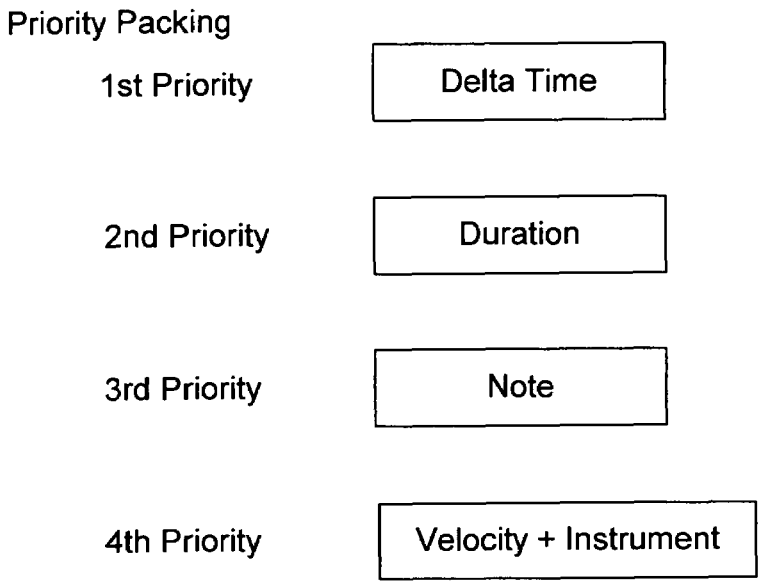
FIG. 8 shows a priority order of packing of event elements used in exemplary compression and decompression processes of the invention.

The details of the operation of searching optimal match between MESW and look-ahead window and the encoding are now described. As mentioned with reference to FIG. 4, each previous event in MESW 41 is looked-up until all maximum search window size is reached. If the previous y-th event in MESW 41 is exactly the same as the event in look-ahead window 42, then the number y is stored in sub-part Y. In this case, as the matching is found, all the bits in the x-bit indicator are set in sub-part X. If there is no perfect match of the current event and the previous event in the MIDI event search window, the previous event number y with the optimal match is stored. In this case, each of the x-bit in sub-part X indicates the matching of each searching element between the y-th event of the MESW and the look-ahead window element. The elements of the look-ahead window event that differ from y-th event element in MESW are stored in part B. It is noted that the storing of the elements follows a priority order of the packing of the event element as shown in FIG. 8. In FIG. 8, the first priority of the packing is the Delta Time. The second priority of packing is the Duration. The third priority of packing is the Note and the fourth priority of packing is the combination of Velocity and Instrument.

It should be noted that the x-bit and y-bit can be adjusted. To find the optimal MESW window-size and which element in MIDI event can be used for optimal match searching for a particular MIDI song, an exhaustive search could be applied on MESW size and different combinations of MIDI event elements to find the case with minimum compressed event size. To do so, two header are added for each MIDI song during compression/encoding. The first header indicates the chosen MESW size and the second header indicates the usage of MIDI event element for matching between the MESW and the MIDI event look-ahead window. Upon decompression/decoding, the two headers are read. The usage of combination of MIDI event of 16 (i.e., y-bit is 4-bit) and the application of Delta Time, Duration, Note and a combination of Velocity and Instrument (i.e., x-bit is 4-bit) are used as an example in the present discussion for illustration.

Referring again to FIG. 3, after index with the optimal match is found and packed to sub-part Y of Part A, the process goes to step 303. At step 303, the process checks whether the Delta Time of the look-ahead window is the same as the Delta Time element in the MESW.

At step 31 1, if Delta Time in the look-ahead window is the same as the Delta Time in MESW with index obtained at step 303, then bit 7 of part A of the codeword is set to "HIGH" or "1". Otherwise, the Delta Time is packed to part B of the codeword, as shown at step 310.

At step 304, the process checks whether the Duration element of the look-ahead window is the same as that in the MESW. If they are the same, bit 6 of part A of the codeword is set to "HIGH" or "1", as shown at step 313. Otherwise, as shown at step 312, the Duration is packed to part B of the codeword.

At step 305, the process checks whether the Note element of the look-ahead window is the same as that in the MESW. At step 315, if they are the same, bit 5 of part A of the codeword is set to "HIGH" or "1". At step 314, if they are not the same, the Note is packed to part B of the codeword.

In accordance with the present invention, it is noted that tempo information is associated into the timing information of the note. The resultant note length is in unit of second for simple playback. Therefore, no tempo information has to be stored for the whole MIDI song.

Similarly, at steps 306, the process checks whether the Velocity and Instrument elements of the look-ahead window are the same as those of the MESW.

As mentioned above, there are five elements included in each MIDI event. Therefore, x-bit of part A should be 5 to indicate the matching of each element of y-th event in MESW and the element of event in the look-ahead window. In this case, y-bit is 3. However, based on the characteristics of a MIDI song, it is quite often that the same instrument is associated with the same velocity. Therefore, by combining event instrument and velocity as a single searching element in the x-bit indicator, y-bit can be increased from 3 to 4 so that the MIDI event search window size can be increased. Furthermore, in this manner, only 1 byte header is needed for each event to store with 4-bit of status information and the maximum search window size can be up to 16 (but needs 4-bit to store), which has much better compression than a window size of 8 in many cases. Accordingly, at step 306, it searches Velocity and Instrument index altogether.

As shown at step 317, if both Velocity and Instrument in the look-ahead window is the same as the Velocity and Instrument in MESW with index obtained at step 302, then bit 4 of part A of the codeword is set to "HIGH" or "1". Otherwise, the Velocity and Instrument is packed to part B of the codeword, as shown at step 316.

At step 307, if no more codeword is decoded, then the compression process ends, at step 318. Otherwise, the process goes to step 308.

In accordance with the present invention, to further improve the compression ratio, instead of updating the MESW for each event, the search window is only updated when there is no perfect match between the MESW and the look-ahead window. Furthermore, duplicate elements in MESW are discarded. In this way, the effective events stored in the MESW could be more than 16.

Therefore, at step 308, if bits 4-7 in part A of the codeword are all set to "HIGH", then there is a perfect match between the look-ahead window and the MESW. In this case, MESW needs not to be updated and the encoding/compression process of this event is completed. If not all bits 4-7 are set, that is, there is no perfect match, the process then goes to step 309 for updating the MESW.

Figure 9:
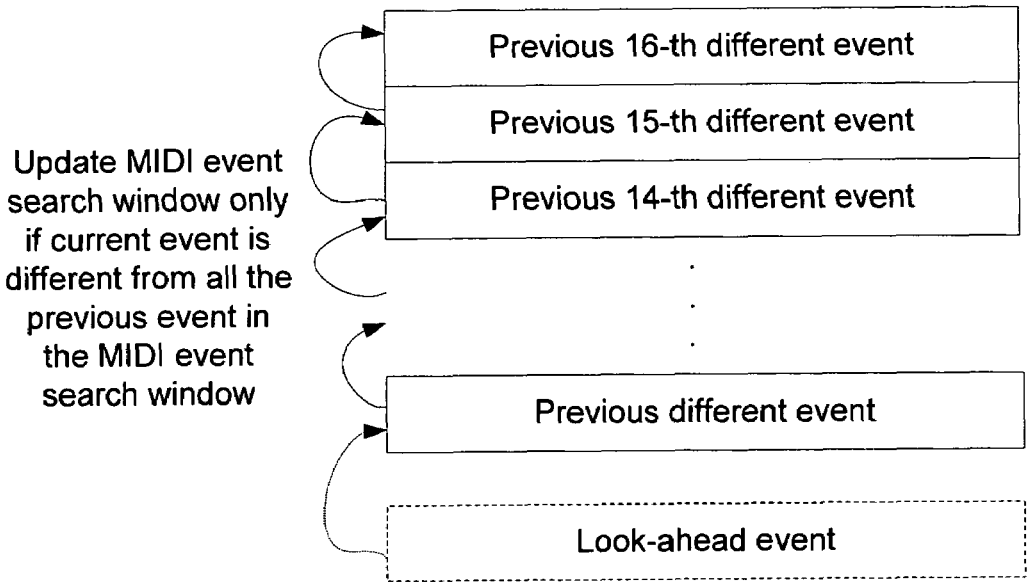
FIG. 9 is a diagram showing an updating manner of a MESW and a look-ahead window, in accordance with a preferred embodiment of the invention.

At step 309, the MESW is updated. The updating manner of the MESW is shown in FIG. 9. Assume that the MESW window size of FIG. 9 is 16. During the updating process, the previous 16-th different event in the MESW is replaced by the previous 15-th different event in the MESW. The previous 15-th different event in the MESW is then replaced by the previous 14-th different event in the MESW. This processing continues until the immediate proceeding different event is replaced by the event in the look-ahead window. In this manner, previous 16-th different event is removed from the MESW and the current event is inserted to the MESW.

At this time, MIDI music data is successfully compressed/encoded into a compressed MIDI file. As shown in FIG. 1, the compressed file is then transferred embedded system 12.

The compressed MIDI file is stored in the ROM/EEPROM of the embedded system. When a user operates to playback the MIDI file, the compressed MIDI file is read by a RAM and is de-compressed by a de-compressor/decoder to recover the MIDI events. The recovered MIDI events are then reproduced into music by a music reproduction module.

Figure 10:
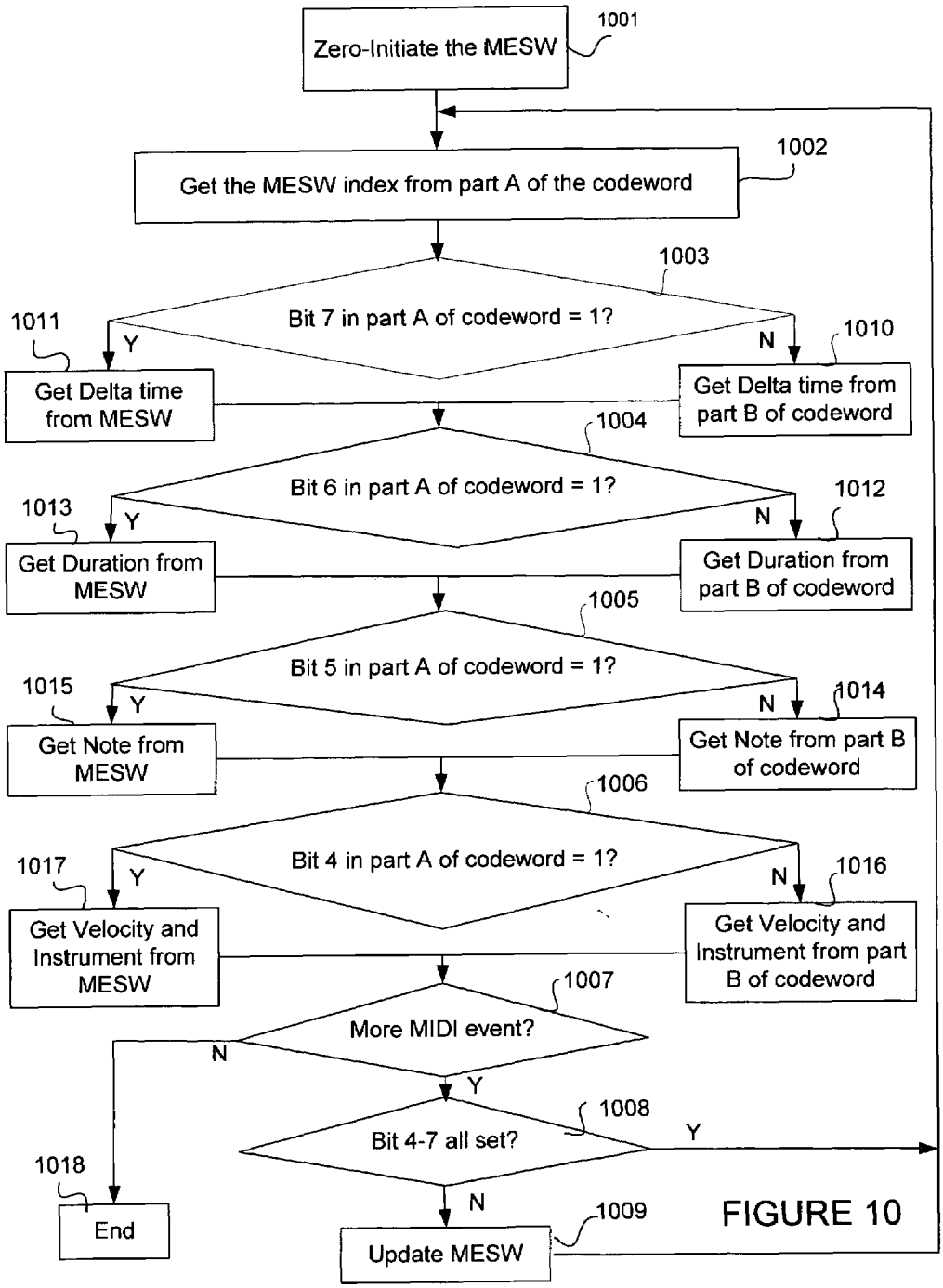
FIG. 10 is a flow chart showing an exemplary decompression process of a preferred embodiment of the invention.

FIG. 10 illustrates an exemplary decompression process of the MIDI file of the invention. It is noted that since the encoding process of the MIDI event follows the priority as described in FIG. 8, for successful decompression, the decoding process also follows the priority of the encoding process. Further, after decompression, each decompressed MIDI event includes the Delta Time (8-bits), Duration (6-bit), Note (6-bit), Velocity (6-bit), and Instrument (4-bit), as shown in FIG. 2. Moreover, a MESW has to be created during the decompression process.

At step 1001, all the MESW elements are initially set to zero.

At step 1002, the MESW index (i.e., sub-part Y in FIG. 6) is obtained from Part A of the encoded MIDI event.

At step 1003, the process checks whether bit-7 of Part A of the codeword is set to "HIGH" or "1". At step 1011, if it is set to "HIGH" or "1", meaning that the Delta Time is set, then the Delta Time is read from the MESW according to the index obtain at step 1002. Otherwise, as shown at step 1010, the Delta Time is read from Part B of the codeword. As described above, the priority of decoding event elements follows the priority of encoding event element that is shown in FIG. 8.

At step 1004, the process checks whether bit-6 of Part A of the codeword is set to "HIGH" or "1". At step 1013, if bit-6 is set to "HIGH" or "1", then the Duration is read from the MESW according to the index obtained at step 1002. Otherwise, as shown at step 1012, the Duration is read from Part B of the codeword.

Similarly, at steps 1005 and 1006, bit-5 and bit-4 of Part A of the codeword are checked, respectively. At step 1015, if bit-5 is set to "HIGH" or "1", meaning the Note is set, then the Note is read from the MESW according to the index obtained at step 1002. Otherwise, as shown at step 1014, the Note is read from Part B of the codeword. In the same manner, at step 1017, if bit-4 is set to "HIGH" or "1", meaning the Velocity and Instrument are set, the Velocity and Instrument are read from MESW according to the index obtained at step 1002. Otherwise, at step 1014, the Velocity and Instrument are read from Part B of the codeword.

At step 1007, if no more codeword is decoded, then the decompression process ends at step 1018.

Otherwise, at step 1008, the process checks whether all bits 4-7 of the codeword are set to "HIGH" or "1". If so, then there is a perfect matching between the look-ahead window and the MESW. As described above, in this case, it is no need to update the MESW and the decoding of this event is completed. The process then goes back to step 1002 to continue decoding the next event.

If not all bits 4-7 of the codeword are set to "HIGH" or "1", at step 1009, the MESW is then updated according to the manner as described in FIG. 9. The updated MESW is then used in the decoding of the next event.

After all of the MIDI events are decoded, the MIDI file is successfully decompressed. Afterward, a playback engine or a music reproduction module (e.g., 124 of FIG. 1) of the embedded system reproduces and plays music songs from the decompressed MIDI file.

The present invention provides a lossless MIDI compression and decompression method that reduces the size of the standard MIDI file but still maintains information to play the MIDI music. The present invention makes use of the high correlation and repetitions between the look-ahead MIDI event and previous set of MIDI events and generates an adjustable-size MESW to allow searching of matched events or event elements in previous window size of MIDI events. Through the concept, the method significantly reduces the memory storage in the embedded system such as cellular telephone and lowers the system BOM costs. Further, the non-complicated decompression method makes it easy to be employed in systems with limited processing power resources.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A method for compressing music data files, comprising:

extracting music data events from a music data file;

generating a music data event search window, wherein the music data event search window comprises a plurality of previous events and is used for searching for at least one previous event that matches with an event of a look-ahead window; and wherein each event comprises a number of event elements;

searching for one previous event in the music data event search window that has optimal matching with the event of the look-ahead window; and storing an index of the optimal matching event in a compressed codeword.

2. The method of claim 1, wherein the music data file is a Music Instrument Digital Interface (MIDI) file.

3. The method of claim 1, wherein the music event search window is a MIDI event search window and has an adjustable size.

4. The method of claim 1, wherein the compressed codeword comprises a part A that is used to store matching information between the optimal matching event in the music event search window and the event of the look-ahead window.

5. The method of claim 4, wherein the part A of the compressed codeword further comprises a sub-part X that is used to store status information that indicates the matching of each searching event element between the optimal matched event of the music data event search window event and the event of the look-ahead window.

6. The method of claim 4, wherein the part A of the compressed codeword further comprises a sub-part Y that is used to store the index of the optimal matching event, wherein the sub-part Y comprises y bits that is a size of the music data event search window.

7. The method of claim 1, wherein each of the music event comprises a plurality of event elements including a Delta time, a Duration, a Note, a Velocity, and an Instrument.

8. The method of claim 4, further comprising comparing if any one of the event elements in the event of the look-ahead window is the same as a corresponding one in the optimal matching event of the music event search window, and setting corresponding bits of part A of the compressed codeword.

9. The method of claim 7, wherein the Velocity and Instrument elements are compared as a unit and correspond to one bit of the codeword.

10. The method of claim 9, wherein the compressed codeword further comprises a part B, wherein if any one of the event elements is not the same as the corresponding one in the event with optimal matching in the music event search window, the different element is packed into the part B of the codeword.

11. The method of claim 9, wherein the plurality of elements are compared in the order of the Delta Time, the Duration, the Note, and the unit of the Velocity and the Instrument.

12. The method of claim 1, wherein each of the music data files includes two headers, the first header indicates a chosen size of the music search event window, and the second header indicates the usage of the event elements of the music data for matching between the music event search window and the look-ahead window.

13. The method of claim 1, further comprising performing an exhaustive search to find an optimal window size of the music event search window and which elements in the music data events can be used for an optimal match searching for a particular music data.

14. The system of claim 1, wherein the music event search window is updated when there is no perfect match between the music event search window and the look-ahead window.

15. A method for decompressing a compressed music data file, comprising:

extracting music data events from the compressed music data file;

generating a music event search window, wherein the music event search window comprises a plurality of previous events and is used for searching for at least one previous event that matches with an event of a look-ahead window; and wherein each event comprises a number of event elements;

obtaining an index of a previous event in the music event search window that has optimal matching with the event of the look-ahead window, the optical matching event comprising a codeword;

checking the codeword of the optimal matching event;

if a respective bit of the codeword of the optimal matching event is set to "HIGH", an event element corresponding to the respective bit is read from the music event search window; and if a respective bit of the codeword of the optimal matching event is not set to "HIGH", an element corresponding to the respective bit is read from the codeword.

16. The method of claim 15, wherein the music event comprises a plurality of elements and the plurality of elements include a Delta time, a Duration, a Note, a Velocity, and an Instrument, each of which corresponds a respective bit of the codeword.

17. The method of claim 16, wherein the Velocity and the Instrument elements are considered as one unit and correspond to one respective bit of the codeword.

18. The method of claim 17, wherein the elements are decompressed in the order of the Delta Time, the Duration, the note, the unit of the Velocity and the Instrument.

19. The method of claim 15, wherein the codeword of the optimal matching event comprises a part A that is used to store matching information between the music event search window and the look-ahead window.

20. The method of claim 19, wherein the part A of the compressed codeword further comprises sub-part X that is used to store status information that indicates the matching of each event element between the optimal matched event of the music search event window and the event of the look-ahead window.

21. The method of claim 20, wherein the part A of the codeword of the optimal matching event further comprises a sub-part Y that is used to store the index of the optimal matching event, wherein the sub-part Y comprises y bits that is a size of a music data event search window.

22. The method of claim 19, wherein the codeword of the optimal matching event further comprises a part B, and wherein if the respective bit of the codeword is not set to "HIGH", the element corresponding to the respective bit is read from part B of the codeword.

23. The method of claim 15, wherein each of the music data files includes two headers, the first header indicates a chosen size of the music search event window, and the second header indicates the usage of the event elements of the music data for matching between the music event search window and the look-ahead window.

24. The system of claim 15, wherein the music event search window is updated when there is no perfect match between the music event search window and the look-ahead window.

25. The method of claim 15, further comprising performing an exhaustive search to find an optimal window size of the music event search window and which elements in the music data events can be used for an optimal match searching for a particular music data.

26. A system for compressing music data files, comprising:

a reader for reading a music data file;

an extractor for extracting music events from the music file;

a compressor for compressing the music events into a compressed music data file; and a search window generator for generating a music event search window, wherein the music event search window is generated during a compression process performed by the compressor, wherein the music event search window comprises a plurality of previous events and is used by the compressor for searching events matched with a look-ahead window event, and wherein each event comprises a number of event elements, and wherein when a previous event in the music event search window that has optimal matching with the event of the look-ahead window is found, an index of the optimal matching event is stored in a compressed codeword.

27. The system of claim 26, wherein the music event search window is a Music Instrument Digital Interface (MIDI) event search window and has an adjustable size.

28. The system of claim 26, wherein the music event comprises a plurality of elements, and the plurality of elements include a Delta time, a Duration, a Note, a Velocity, and an Instrument.

29. The system of claim 28, wherein the plurality of elements of the music events of the compressed music data are compressed into the compressed music data according to a priority order.

30. The system of claim 26, wherein the compressor compares whether a respective one of the plurality of elements of the event in the music event search window is the same as a corresponding one of the plurality of the event in the look-ahead window, and if so, sets a corresponding bit of the codeword to be "HIGH".

31. The system of claim 30, wherein the compressor packs the respective element into the codeword if the respective one of the plurality of elements of the event in the music event search window is not the same as the corresponding one of the plurality of elements of the event in the look-ahead window.

32. The system of claim 28, wherein the Velocity and the Instrument elements are compared as a unit and correspond to one bit of the codeword.

33. The system of claim 26, wherein the compressed codeword comprises a part A and a part B, and part A is used to store matching information between the music event search window and the look-ahead window.

34. The system of claim 33, wherein the part A of the compressed codeword further comprises sub-part X that is used to store status information that indicates the matching of each event element between the optimal matched event of the music event search window and the event of the look-ahead window.

35. The system of claim 34, wherein the part A of the compressed codeword further comprises a sub-part Y that is used to store the index of the optimal matching event, wherein the sub-part Y comprises y bits that is a size of a music data event search window.

36. The system of claim 26, wherein each of the music data files includes two headers, the first header indicates a chosen size of the music search event window, and the second header indicates the usage of the event elements of the music data for matching between the music event search window and the look-ahead window.

37. The system of claim 26 wherein the music event search window is updated when there is no perfect match between the music event search window and the look-ahead window.

38. The system of claim 26, wherein an optimal size of the music event search window is determined by performing an exhaustive search, the exhaustive search further looks for which elements in the music data events can be used for an optimal match searching for a particular music data.

39. A system for decompressing music data files, comprising:

a reader for reading the music data files, wherein the music data files are compressed music data;

a decompressor for extracting music events from the compressed music data and decompressing the music events;

a search window generator for generating a music event search window during a decompression process performed by the decompressor; and a music reproduction module for receiving decompressed music data from the decompressor and playing music songs corresponding to the decompressed music data, wherein the music event search window comprises a plurality of previous events and is used for searching an event that is optimal matched with a look-ahead window event; and wherein each event comprises a number of event elements;

wherein the decompressor obtains an index of the optimal matched event in the music event search window, wherein the optimal matched event of the music event search window comprises a codeword, and wherein the decompressor decompresses the compressed music data according to the index.

40. The system of claim 39, wherein the music event search window is a Music Instrument Digital Interface (MIDI) event search window and has an adjustable size.

41. The system of claim 39, wherein each event comprises a plurality of elements, and the plurality of elements include a Delta Time, a Duration, a Note, a Velocity, and an Instrument.

42. The system of claim 41, wherein the plurality of elements of the music events of the compressed music data are decompressed into the decompressed music data according to a priority order.

43. The system of claim 42, wherein the decompressor decompresses all of the plurality of elements contained in the music event according to the priority order used in the compressed music data.

44. The system of claim 39, wherein the codeword comprises a part A and a part B, and the part A is used to store matching information between the optimal matched event of the music event search window and the look-ahead window event.

45. The system of claim 44, wherein the decompressor checks whether a respective bit of the part A of the codeword is set to "HIGH", and if so, the decompressor reads an element corresponding to the respective bit.

46. The system of claim 45, wherein the decompressor reads the element corresponding to the respective bit from the part B of the codeword if the respective bit of the part A of the codeword is not set to "HIGH".

47. The system of claim 44, wherein part A of the compressed codeword further comprises sub-part X that is used to store status information that indicates the matching of each searching event element between the optimal matched event of the music data event search window and the look-ahead window event.

48. The system of claim 47, wherein the Velocity and the Instrument elements are considered as a unit and correspond to one bit of the codeword.

49. The system of claim 47, wherein the part A of the compressed codeword further comprises a sub-part Y that is used to store the index of the optimal matched event and wherein the sub-part Y comprises y bits that is a size of a music data event search window.

50. The system of claim 39, wherein each of the music data files includes two headers, the first header indicates a chosen size of the music search event window, and the second header indicates the usage of the event elements of the music data for matching between the music event search window and the look-ahead window.

51. The system of claim 39, wherein the music event search window is updated when there is no perfect match between the music event search window and the look-ahead window.

52. The system of claim 39, wherein an optimal size of the music event search window is determined by performing an exhaustive search, the exhaustive search further looks for which elements in the music data events can be used for an optimal match searching for a particular music data.

* * * * *